US009461366B2

(12) United States Patent
Park et al.

(10) Patent No.: US 9,461,366 B2
(45) Date of Patent: Oct. 4, 2016

(54) ULTRA-WIDEBAND DUAL LINEAR POLARIZED WAVE WAVEGUIDE ANTENNA FOR COMMUNICATION

(75) Inventors: Chan Goo Park, Daejeon (KR); Jun Hee Lee, Gak-ri (KR)

(73) Assignee: Wiworld Co., Ltd., Daejeon (KR)

( * ) Notice: Subject to any disclaimer, the term of this patent is extended or adjusted under 35 U.S.C. 154(b) by 190 days.

(21) Appl. No.: 14/116,077

(22) PCT Filed: Nov. 24, 2011

(86) PCT No.: PCT/KR2011/009006

§ 371 (c)(1),
(2), (4) Date: Nov. 6, 2013

(87) PCT Pub. No.: WO2012/169709

PCT Pub. Date: Dec. 13, 2012

(65) Prior Publication Data

US 2014/0145893 A1 May 29, 2014

(30) Foreign Application Priority Data

Jun. 9, 2011 (KR) ..... 10-2011-0055489

(51) Int. Cl.
*H01Q 13/02* (2006.01)
*H01Q 21/06* (2006.01)
*H01Q 15/24* (2006.01)

(52) U.S. Cl.
CPC ..... *H01Q 13/02* (2013.01); *H01Q 15/24* (2013.01); *H01Q 21/064* (2013.01)

(58) Field of Classification Search
CPC ..... H01Q 13/02; H01Q 15/24; H01Q 21/064
USPC ..... 343/756
See application file for complete search history.

(56) References Cited

U.S. PATENT DOCUMENTS

| | | | | |
|---|---|---|---|---|
| 5,926,147 | A | 7/1999 | Sehm et al. | |
| 6,201,508 | B1 | 3/2001 | Metzen et al. | |
| 6,225,960 | B1 * | 5/2001 | Collins | 343/786 |
| 6,861,996 | B2 * | 3/2005 | Jeong | 343/770 |

FOREIGN PATENT DOCUMENTS

| | | | |
|---|---|---|---|
| JP | 2001189618 | A | 7/2001 |
| KR | 20020075209 | A | 10/2002 |
| KR | 100342111 | B1 | 11/2002 |
| KR | 1020080053156 | A | 6/2008 |

(Continued)

*Primary Examiner* — Sue A Purvis
*Assistant Examiner* — Bamidele A Jegede
(74) *Attorney, Agent, or Firm* — The Webb Law Firm

(57) ABSTRACT

Provided is a ultra-wideband dual linear polarized wave waveguide antenna for communication having a wideband matching structure in which the inner peripheral surface of the first polarized wave filtering unit or the second polarized wave filtering unit, which filters a first polarized wave or a second polarized wave entering the dual linear polarized wave waveguide antenna and orthogonal to each other, are tapered such that a diameter of the inner peripheral surface becomes smaller, and having an extended path so as to adjust the first polarized wave and the second polarized wave so that they are in-phase. By doing so, the ultra-wideband dual linear polarized wave waveguide antenna is capable of both receiving and transmitting and thus can be used for communication, and can adjust skew angles without being mechanically rotated.

4 Claims, 14 Drawing Sheets

(56) References Cited

FOREIGN PATENT DOCUMENTS

| | | | | |
|---|---|---|---|---|
| KR | 1020090024058 A | | 3/2009 | |
| KR | 1020100064428 A | | 6/2010 | |
| WO | WO 2008069358 A1 | * | 6/2008 | ..... H01Q 13/02 |
| WO | WO 2009066828 A1 | * | 5/2009 | ..... H01Q 1/22 |
| WO | WO 2009078630 A1 | * | 6/2009 | ..... H01Q 13/02 |

* cited by examiner

Prior Art

ULTRA-WIDEBAND DUAL LINEAR POLARIZED WAVE WAVEGUIDE ANTENNA FOR COMMUNICATION

CROSS-REFERENCE TO RELATED APPLICATIONS

This application is the United States national phase of International Application No. PCT/KR2011/009006 filed Nov. 24, 2011, and claims priority to Korean Patent Application No. 10-2011-0055489 filed Jun. 9, 2011, the disclosures of which are hereby incorporated in their entirety by reference.

TECHNICAL FIELD

The present invention relates to an ultra-wideband dual linear polarized wave waveguide antenna for communication, and more particularly, to an ultra-wideband dual linear polarized wave waveguide antenna for communication having a wideband matching structure in which the inner peripheral surface of the first polarized wave filtering unit or the second polarized wave filtering unit, which filters a first polarized wave or a second polarized wave entering the dual linear polarized wave waveguide antenna and orthogonal to each other, are tapered such that a diameter of the inner peripheral surface becomes smaller, and having an extended path so as to adjust the first polarized wave and the second polarized wave so that they are in-phase. By doing so, the ultra-wideband dual linear polarized wave waveguide antenna is capable of both receiving and transmitting and thus can be used for communication, and can adjust skew angles without being mechanically rotated.

BACKGROUND ART

Among general satellite antennas, planar waveguide antennas are to receive satellite broadcasting.

A planar waveguide antenna has a horn-like front end and opened sides, so that one side of the waveguide is vibrated and electromagnetic waves move along the waveguide to be irradiated to the air. Here, since impedance is not matched between the waveguide and the air, some of the waves are reflected and thus not all of the energy is irradiated to the air.

Therefore, a waveguide antenna is designed such that the opening of the waveguide is gradually enlarged so as to match impedance between the waveguide and the air, to thereby maximize the amount of energy irradiated from the opening.

FIG. 1 is a cross-sectional view of a horn of a typical waveguide antenna through which a signal passes. As shown, the horn antenna has an outer opening 2 facing the air and an inner opening 3 from which vibration originates.

The waveguide antenna to receive broadcasting as described above only receives signals and thus has a narrow bandwidth of operating frequency, i.e., from 10.7 GHz to 12.7 GHz.

The operating frequency of existing Ku-band planar waveguide antennas are limited to the reception band from 10.7 GHz to 12.7 GHz or to the transmission band from 13.75 GHz to 14.5 GHz, and thus they are receiving-only or transmitting-only.

A satellite antenna has a different elevation angle and a skew angle depending on where it is located, and thus the type and specification of the antenna should be determined taking into account the skew angle and the elevation angle of a location.

A skew angle refers to a difference between the angle at which low-noise block downconverter (LNB) receives signals and the angle at which a satellite transmits signals, and it differs from location to location since Earth is round.

For example, the latitude and longitude of Perth city in Western Australia is 31° S and 115° E, respectively, and those of Canberra city in Eastern Australia, which is the capital city, is 35° S and 149° E, respectively, and the former has a skew angle of −50° and the latter has a skew angle of −15°, which are quite different.

Therefore, in order for a satellite antenna to respond to the difference in skew angles at different locations, skew angles need to be adjustable. However, the planar waveguide antennas need to be mechanically rotated in order to adjust skew angles, which is cumbersome, requires large space, and is less accurate.

DISCLOSURE

Technical Problem

An object of the present invention is to provide an ultra-wideband dual linear polarized wave waveguide antenna for communication having a wideband matching structure in which the inner peripheral surface of the first polarized wave filtering unit or the second polarized wave filtering unit, which filters a first polarized wave or a second polarized wave entering the signal input/output unit and orthogonal to each other, are tapered such that a diameter of the inner peripheral surface becomes smaller, and having an extended path so as to adjust the first polarized wave and the second polarized wave so that they are in-phase. By doing so, the ultra-wideband dual linear polarized wave waveguide antenna is capable of both receiving and transmitting and thus can be used for communication, and can adjust skew angles without being mechanically rotated.

Technical Solution

In one general aspect, an ultra-wideband dual linear polarized wave waveguide antenna 1 for communication includes: a signal input/output unit 110 that receives a first polarized wave S1 and a second polarized wave S2 orthogonal to each other; a first polarized wave filtering unit 120 that filters the first polarized wave S1 provided from the signal input/output unit 110 and has stair-like steps formed on its inner peripheral surface; and a second polarized wave filtering unit 130 that filters the second polarized wave S2 provided from the signal input/output unit 110 and making an angle at 90 degrees with the first polarized wave S1 and has a square pillar shape, wherein the inner peripheral surface of the first polarized wave filtering unit 120 or the second polarized wave filtering unit 130 is tapered as it extends away from the signal input/output unit 110 for wideband matching such that a diameter of the inner peripheral surface becomes smaller.

The ultra-wideband dual linear polarized wave waveguide antenna 1 for communication may include a first polarized wave guide 200 that is connected to an opening formed where the steps of the first polarized wave filtering unit 120 are formed so as to guide the first polarized wave S1; and a second polarized wave guide 300 that is connected to the second polarized wave filtering unit 130 on the opposite side to the signal input/output unit 110 so as to guide the second polarized wave S2.

The ultra-wideband dual linear polarized wave waveguide antenna may include: a first layer 10 in which a plurality of the signal input/output units 110 is arranged; a second layer 20 connected to the signal input/output unit 110 and having the first polarized wave guide 200 formed therein; and a third layer 30 connected to the signal input/output unit 110, arranged in parallel to the first polarized wave guide 200 and having the second polarized wave guide 300 formed therein.

A first outlet 400 through which the first polarized wave S1 exits or enters may be penetrated into the second layer 20 and may be connected to the first polarized wave guide 200, and a second outlet 520 through which the second polarized wave S2 exits or enters may be penetrated into the third layer 30 and may be connected to the second polarized wave guide 300, wherein a 1-1 outlet 510 that is connected to the first outlet 400 formed in the second layer 20 may be further penetrated into the third layer 30.

The 1-1 outlet 510 and the second outlet 520 may have a rectangular shape with the rotation angle of 90 degrees with respect to each other.

At least one side of the 1-1 outlet 510 and the second outlet 520 may meet the WR-75 waveguide standard.

A third outlet 430 may be further penetrated into the second layer 20 which is connected to the first outlet so as to allow the first polarized wave S1 to exit or enter, and a circular 3-1 outlet 530 may be further penetrated into the third layer 30 which is connected to the second outlet 520 in the third layer 30 and may be connected to the third outlet 430 in the second layer, and wherein a groove-like, first block insertion groove 810 may be formed in the path connecting the third outlet 430 and the first outlet 400, and a groove-like, second block insertion groove 820 may be formed in the path connecting the second outlet 520 and the 3-1 outlet 530, wherein a first shield block 910 or a second shield block 920 may be inserted into the first block insertion groove 810 or the second block insertion groove 820, respectively, so that selection is made between rectangular wave guides including the 1-1 outlet 510 and the second outlet 520 and a circular wave guide which is the 3-1 outlet 530.

The ultra-wideband dual linear polarized wave waveguide antenna may include an extended path 700 a part of which is bent at a first exit path 610 or a second exit path 620 so that the first outlet 400 and the first polarized wave guide 200 in the second layer 20 are connected to the linear first exit path 610, the 1-1 outlet 510 and the second outlet 520 and the second polarized wave guide 300 in the third layer 30 are connected to the linear second exit path 620, and the first polarized wave S1 passing through the first exit path or the second polarized wave S2 passing through the second exit path 620 may circle at a certain area so as to extend the length of passing.

The extended path 700 may have one of U-, V-, W-, and N-shapes.

The ultra-wideband dual linear polarized wave waveguide antenna may further include a cover member 2 that covers the outside and has a multi-layer structure of two or more layers made of different materials.

The cover member 2 may have a three-layered structure in which a first sheet 41 and a third sheet 43 are made of ABS or prepreg sheets and located at the first layer and at the third layer, respectively; and a second sheet 42 is made of a honeycomb sheet formed of aramid material or Styrofoam and located at the second layer therebetween.

Advantageous Effects

According to the present invention, an ultra-wideband dual linear polarized wave waveguide antenna for communication according to the present disclosure has a wideband matching structure in which the inner peripheral surface of the first polarized wave filtering unit or the second polarized wave filtering unit are tapered, which filter the first polarized wave or the second polarized wave coming through the signal input/output unit and orthogonal to each other, and thus the bandwidth is enlarged up to 10.7 GHz to 14.5 GHz, so as to include both of the reception band and transmission band, so that it is capable of both receiving and transmitting.

Further, the ultra-wideband dual linear polarized wave waveguide antenna for communication according to the present disclosure is provided with an extended path that extends the waveguide path so that the first polarized wave and the second polarize wave are in-phase, and thus skew angles can be adjusted without mechanically rotating the antenna.

In addition, the ultra-wideband dual linear polarized wave waveguide antenna for communication according to the present disclosure is capable of both receiving and transmitting and of adjusting skew angles, so that dual linear polarized wave antenna which has previously been used for receiving satellite broadcasting can extend its applications, and can make better use of a space since it does not require mechanical rotation for adjusting skew angles.

Moreover, the ultra-wideband dual linear polarized wave waveguide antenna for communication according to the present disclosure includes a cover member that covers the outside and has a multi-layer structure made of different materials, thereby to minimize the propagation loss factor.

DESCRIPTION OF DRAWINGS

The above and other objects, features and advantages of the present invention will become apparent from the following description of preferred embodiments given in conjunction with the accompanying drawings, in which.

BEST MODE

Figure 1:
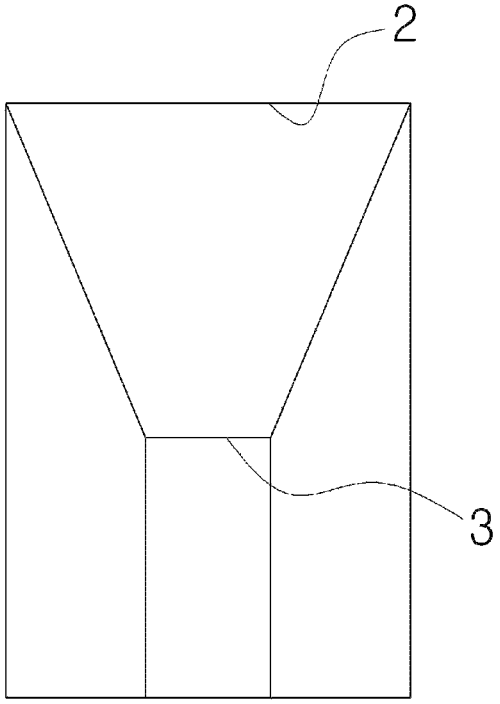
FIG. 1 is a cross-sectional view of a horn of a typical waveguide antenna.

Hereinafter, an ultra-wideband dual linear polarized wave waveguide antenna for communication according to the present disclosure will be described in more detail with reference to the accompanying drawings.

The ultra-wideband dual linear polarized wave waveguide antenna 1 for communication according to the present disclosure includes a signal input/output unit 110 that receives and transmits a first polarized wave S1 and a second polarized wave S2 orthogonal to each other; a first polarized wave filtering unit 120 that filters the first polarized wave S1 provided from the signal input/output unit 110 and has stair-like steps formed on the inner peripheral surface; and a second polarized wave filtering unit 130 that filters the second polarized wave S2 provided from the signal input/output unit 110 and making an angle of 90 degree with the first polarized wave S1 and has a square pillar shape.

In particular, unlike existing waveguide antennas that are receive-only antennas having bandwidth from 10.7 GHz to 12.7 GHz, the ultra-wideband dual linear polarized wave waveguide antenna 1 for communication according to the present disclosure has wide band from 10.7 GHz to 14.5 GHz including transmission band from 13.75 GHz to 14.5 GHz, so that it is capable of receiving and transmitting.

To this end, the ultra-wideband dual linear polarized wave waveguide antenna 1 for communication according to the present disclosure has a wideband matching structure in which the inner peripheral surface of the first polarized wave filtering unit 120 or the second polarized wave filtering unit 130 is tapered as it extends away from the signal input/output unit 110 such that a diameter of the inner peripheral surface becomes smaller.

As described above, the first polarized wave filtering unit 120 or the second polarized wave filtering unit 130 has a truncated cone structure in which the inner peripheral surface is tapered, so that the impedance matching characteristic is not limited to a certain band of frequency but impedance may be matched in a wide range.

Accordingly, the ultra-wideband dual linear polarized wave waveguide antenna 1 for communication according to the present disclosure may have a wide operating characteristic from 10.7 GHz to 14.5 GHz.

Further, the ultra-wideband dual linear polarized wave waveguide antenna 1 for communication may include a first polarized wave guide 200 that is connected to an opening formed where the steps of the first polarized wave filtering unit 120 are formed so as to guide the first polarized wave S1; and a second polarized wave guide 300 that is connected to the second polarized wave filtering unit 130 on the opposite side to the signal input/output unit 110 so as to guide the second polarized wave S2.

The first polarized wave guide 200 is connected between two adjacent first polarized wave filtering units 120 and may increase the strength of a signal in a such manner that first polarized waves S1 each filtered by the respective first polarized wave filtering units 120 are combined and then the combined first polarized wave is again combined with an adjacent combined first polarized wave S1 into which two adjacent first polarized waves S1 have been combined likewise, and so on.

Similarly to the first polarized wave guide 200, the second polarized wave guide 300 is connected between two adjacent second polarized wave filtering units 130 and may increase the strength of a signal in a such manner that second polarized waves S2 each filtered by the respective second polarized wave filtering units 130 are combined and then the combined second polarized wave S2 is again combined with an adjacent combined second polarized wave S2 into which two adjacent second polarized waves S2 have been combined likewise, and so on.

Figure 2:
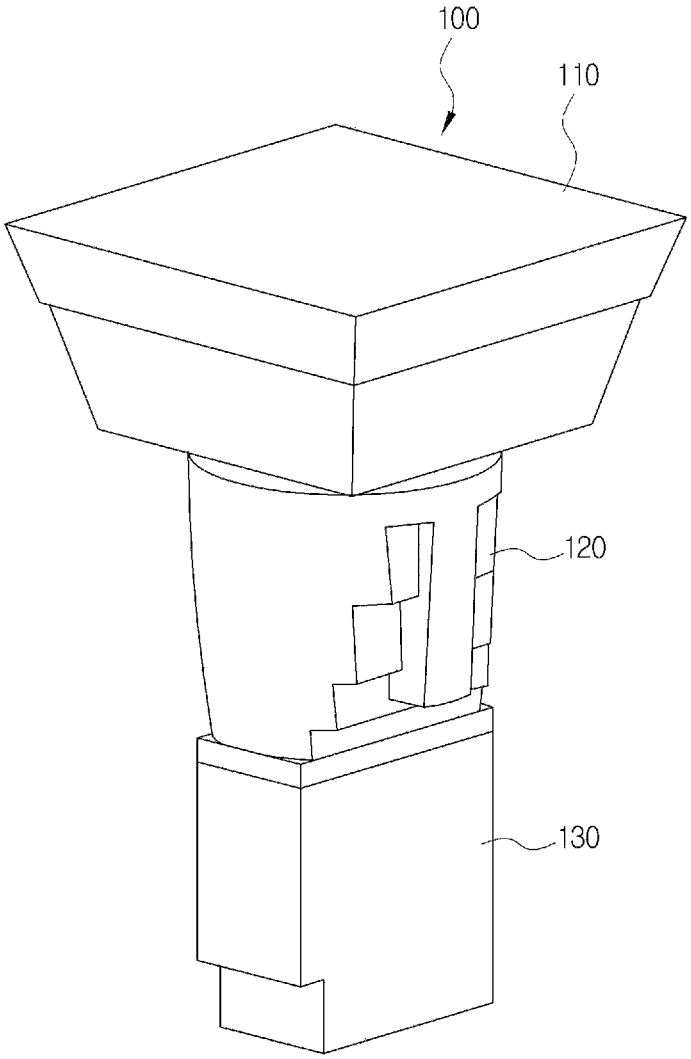
FIG. 2 is a perspective view illustrating inside of an ultra-wideband dual linear polarized wave waveguide antenna for communication according to an embodiment of the present invention.
Figure 3:
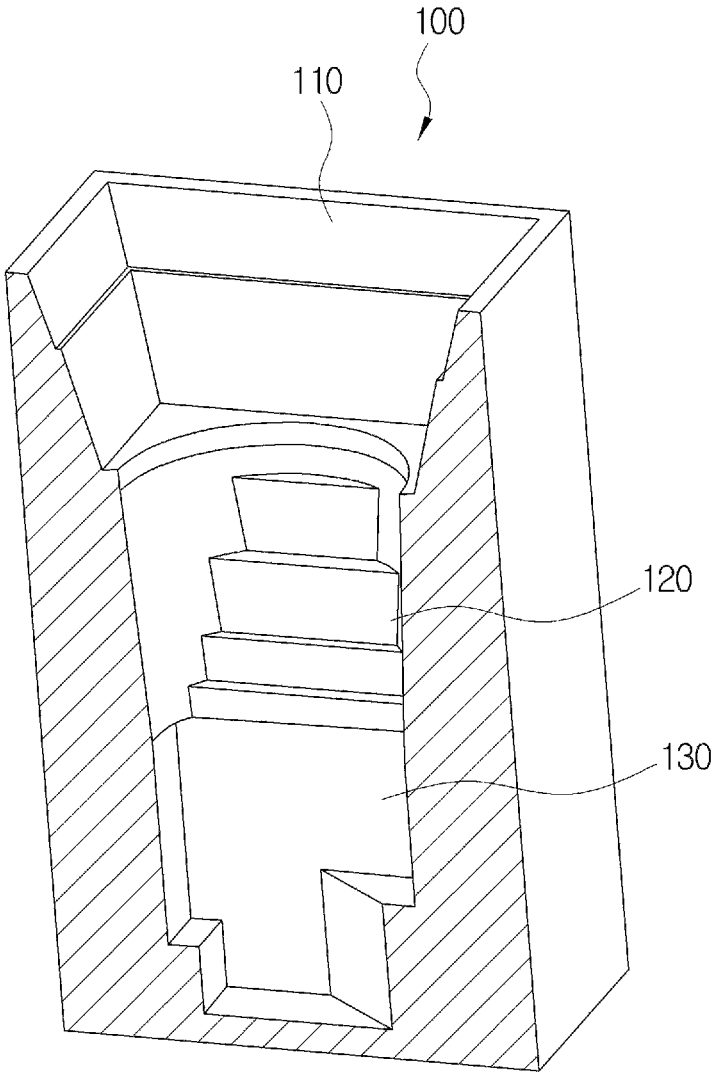
FIG. 3 is a cross-sectional view of an ultra-wideband dual linear polarized wave waveguide antenna for communication according to an embodiment of the present invention.
Figure 4:
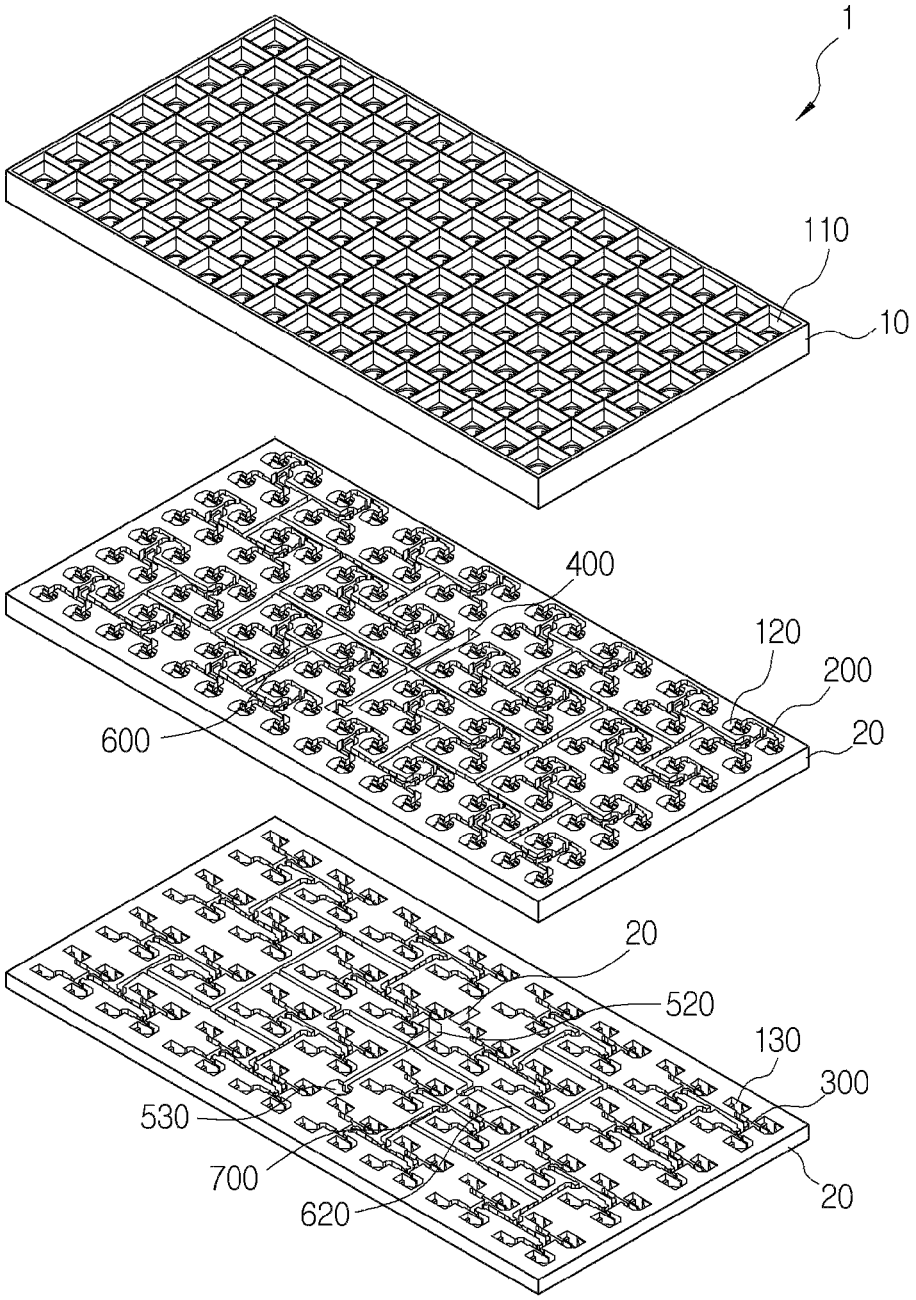
FIG. 4 is an exploded perspective view illustrating individual layers of an ultra-wideband dual linear polarized wave waveguide antenna for communication according to an embodiment of the present invention.
Figure 5:
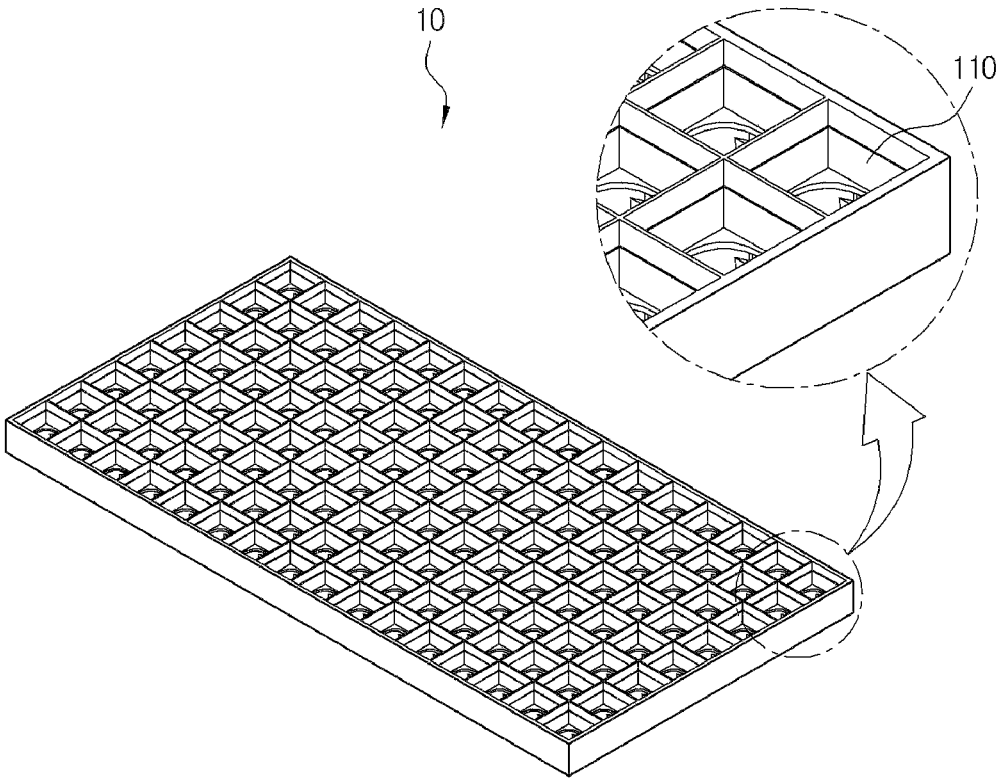
FIG. 5 is a perspective view of a first layer of an ultra-wideband dual linear polarized wave waveguide antenna for communication according to an embodiment of the present invention.
Figure 6:
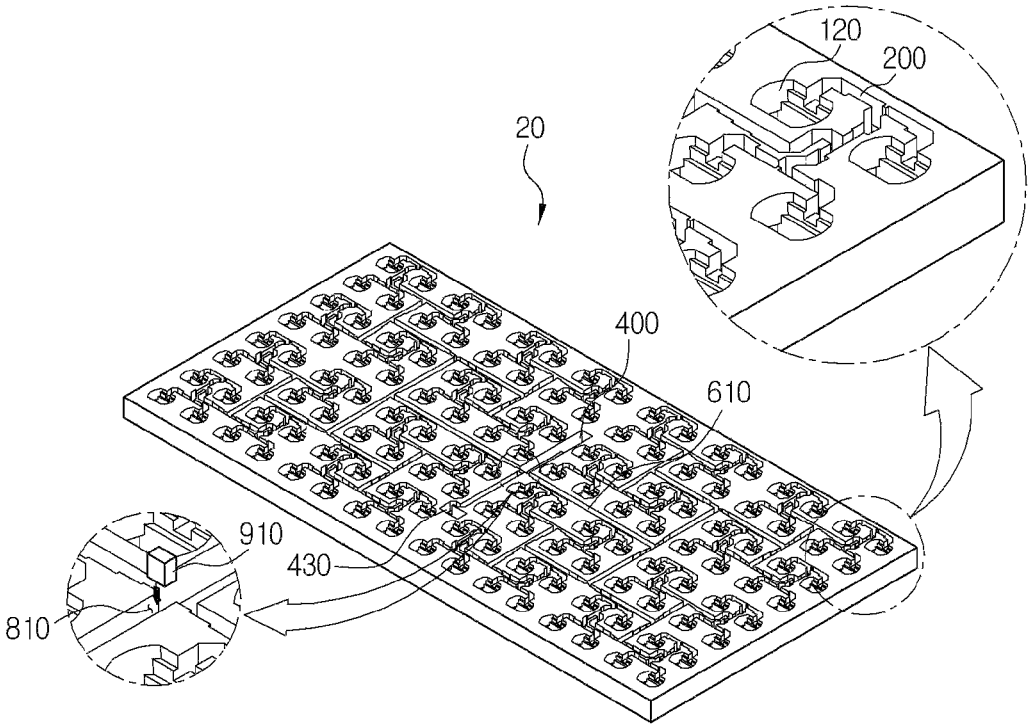
FIG. 6 is a perspective view of a second layer of an ultra-wideband dual linear polarized wave waveguide antenna for communication according to an embodiment of the present invention.
Figure 7:
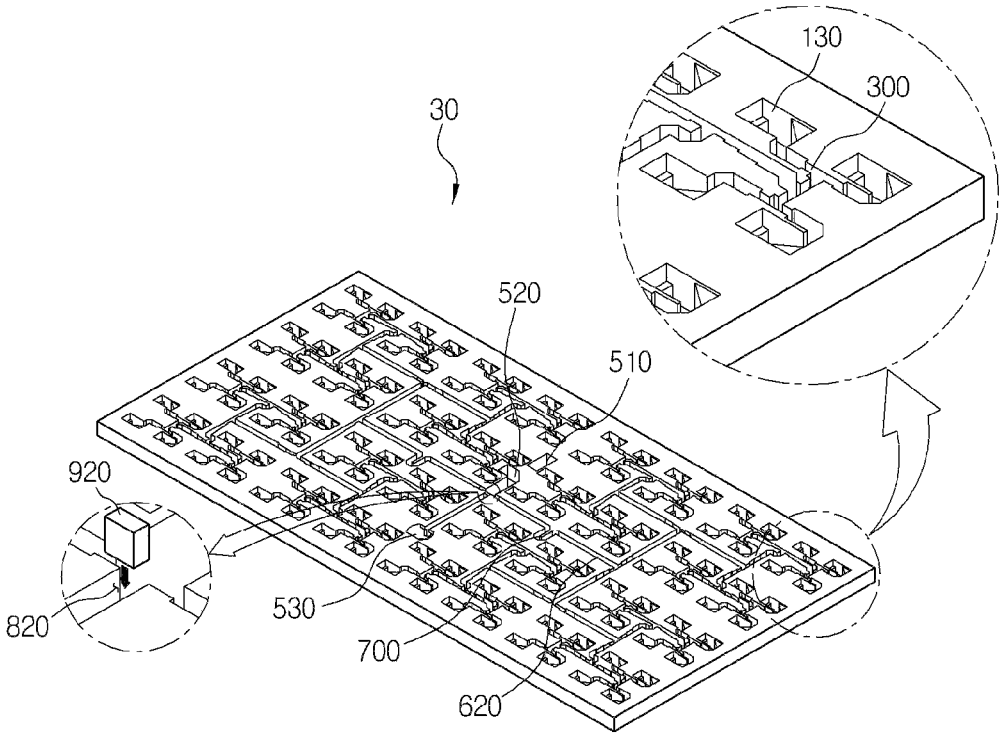
FIG. 7 is a perspective view of a third layer of an ultra-wideband dual linear polarized wave waveguide antenna for communication according to an embodiment of the present invention.
Figure 8:
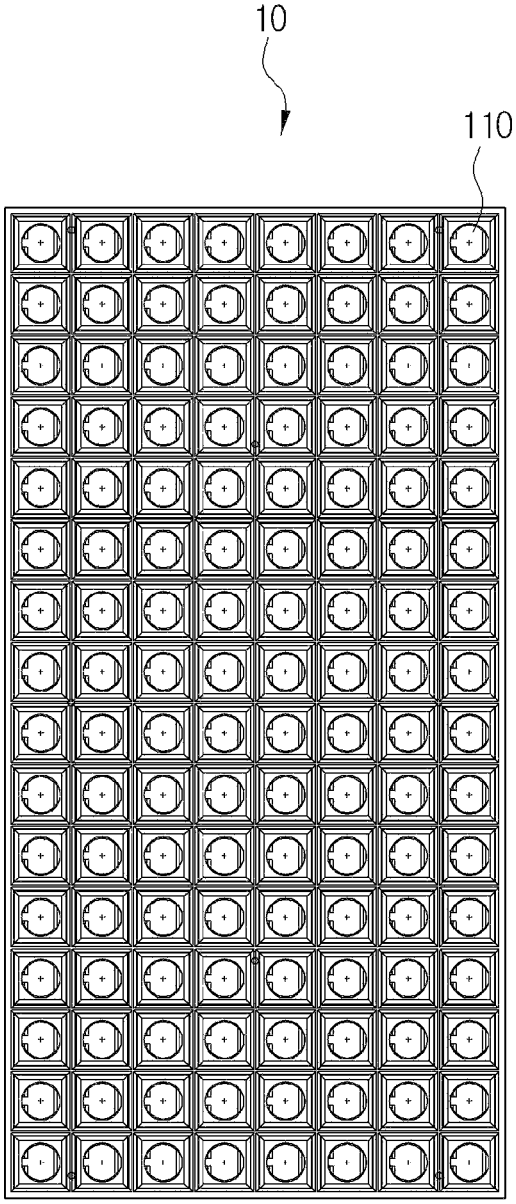
FIG. 8 is a plan view of a first layer of an ultra-wideband dual linear polarized wave waveguide antenna for communication according to an embodiment of the present invention.

As shown in FIGS. 2 and 3, suppose that a signal input/output unit 110, a first polarized wave filtering unit 120 and a second polarized wave filtering unit 130 make up one unit antenna 100, the ultra-wideband dual linear polarized wave waveguide antenna 1 for communication according to the present disclosure may allow a stronger signal to exit or enter in a such manner that a plurality of unit antennas 100 are arranged such that a first polarized wave S1 or a second polarized wave S2 incident between adjacent unit antennas 100 are combined.

The ultra-wideband dual linear polarized wave waveguide antenna 1 for communication according to the present disclosure is configured such that a plurality of unit antennas 100 are arranged so as to allow a strong signal to exit or enter, and may include a first layer 10 in which a plurality of the signal input/output units 110 is arranged; a second layer 20 connected to the signal input/output unit 110 and having the first polarized wave guide 200 formed therein; and a third layer 30 connected to the signal input/output unit 110, arranged in parallel to the first polarized wave guide 200, and having the second polarized wave guide 300 formed therein.

Further, the ultra-wideband dual linear polarized wave waveguide antenna 1 for communication according to the present disclosure is configured such that a first outlet 400 through which the first polarized wave S1 exits or enters is penetrated into the second layer 20 and is connected to the first polarized wave guide 200, and a second outlet 520 through which the second polarized wave S2 exits or enters is penetrated into the third layer 30 and is connected to the second polarized wave guide 300. In the third layer 30, a 1-1 outlet 510 that is connected to the first outlet 400 formed in the second layer 20 may be penetrated therein.

Figure 9:
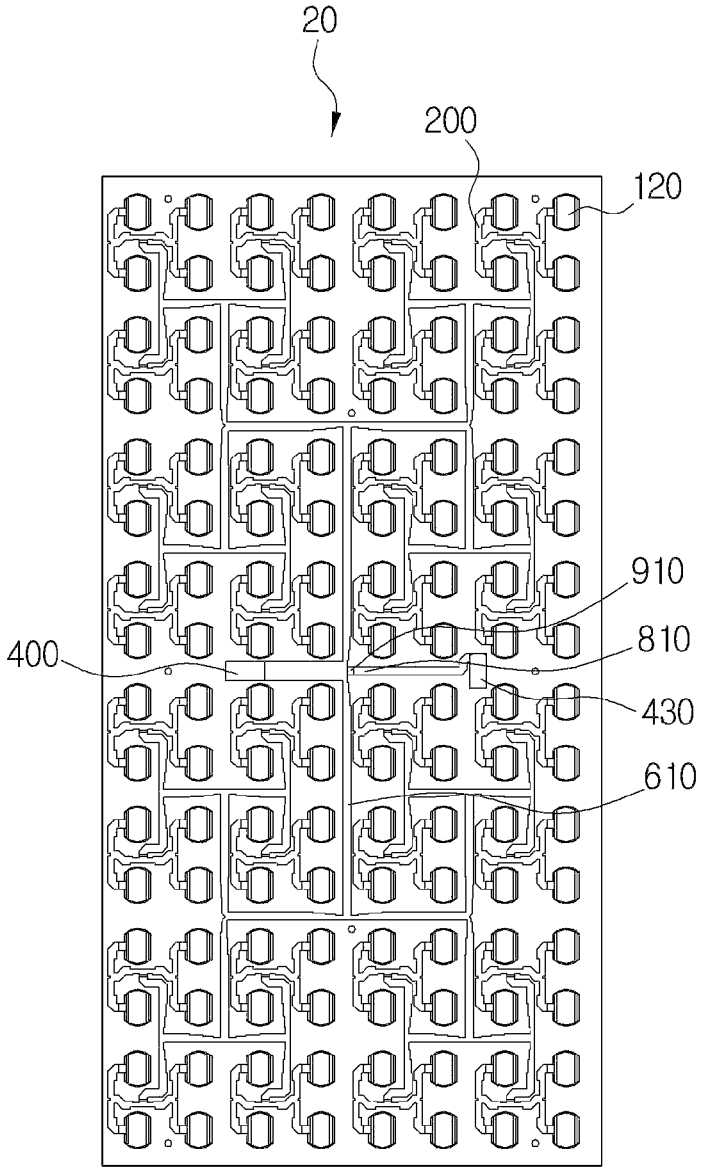
FIG. 9 is a plan view of a second layer of an ultra-wideband dual linear polarized wave waveguide antenna for communication according to an embodiment of the present invention.

In a receiving mode, as shown in FIG. 9, the second layer 20 is configured such that the first polarized wave S1 filtered by the first polarized wave filtering unit 120 is combined with an adjacent first polarized wave S1 filtered by the first polarized wave filtering unit 120 through the first polarized wave guide 200, and then the combined first polarized wave S1 is again combined with an adjacent combined first polarized wave, and so on, and finally a resulting wave exits through the first outlet 400.

Figure 10:
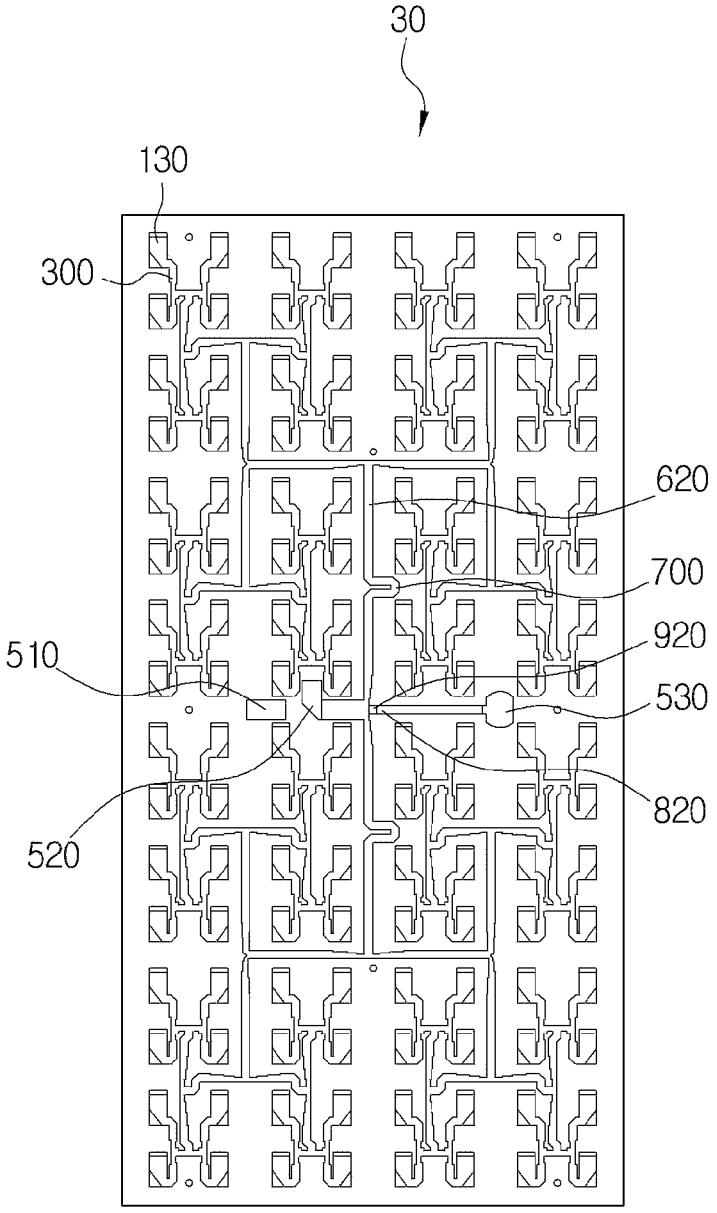
FIG. 10 is a plan view of a third layer of an ultra-wideband dual linear polarized wave waveguide antenna for communication according to an embodiment of the present invention.

In the receiving mode, as shown in FIG. 10, the third layer 30 is configured such that the second polarized wave S2 filtered by the second polarized wave filtering unit 130 is combined with an adjacent second polarized wave S2 filtered by the second polarized wave filtering unit 130 through the second polarized wave guide 300, and then the combined second polarized wave S2 is again combined with an adjacent combined second polarized wave, and so on, and finally a resulting wave exits through the second outlet 520.

Figure 11:
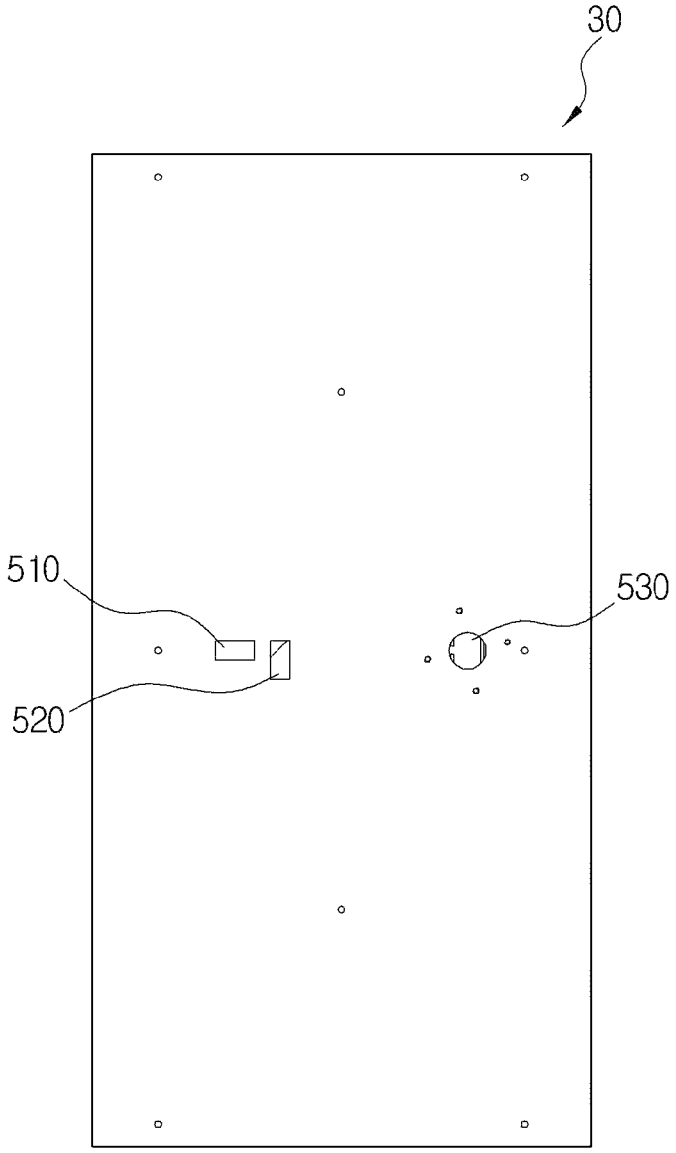
FIG. 11 is a plan view of the rear surface of a third layer of an ultra-wideband dual linear polarized wave waveguide antenna for communication according to an embodiment of the present invention.

In the third layer 30, the 1-1 outlet 510 connected to the first outlet 400 formed in the second layer 20 is further formed, so that both of the 1-1 outlet 510 and the second outlet 520 are visible on the rear surface of the third layer 30, as shown in FIG. 11.

In particular, the 1-1 outlet 510 and the second outlet 520 may have a rectangular shape with the rotation angle of 90 degrees with respect to each other. At least one side may meet WR-75 waveguide standard 19*9.5 mm, so that they may be used as a Ku-band antenna.

Further, the ultra-wideband dual linear polarized wave waveguide antenna 1 for communication according to the present disclosure is configured such that a third outlet 430 is further penetrated into the second layer 20 which is connected to the first outlet so as to allow the first polarized wave S1 to exit or enter, and a circular 3-1 outlet 530 is further penetrated into the third layer 30 which is connected to the second outlet 520 in the third layer 30 and is connected to the third outlet 430 in the second layer.

Here, in the second layer 20, a groove-like, first block insertion groove 810 may be formed in the path connecting the third outlet 430 and the first outlet 400. In the third layer 30, a groove-like, second block insertion groove 820 may be formed in the path connecting the second outlet 520 and the 3-1 outlet 530.

Further, the ultra-wideband dual linear polarized wave waveguide antenna 1 for communication according to the present disclosure may be configured such that a first shield block 910 or a second shield block 920 is inserted into the first block insertion groove 810 or the second block insertion groove 820, respectively, so that selection is made between an rectangular wave guide including the 1-1 outlet 510 and the second outlet 520 and a circular wave guide which is the 3-1 outlet 530.

Accordingly, the ultra-wideband dual linear polarized wave waveguide antenna 1 for communication according to the present disclosure may allow the first polarized wave S1 and the second polarized wave S2 orthogonal to each other to exit or enter through the 1-1 outlet 510 and the second outlet 520, respectively, and may allow the first polarized wave S1 and the second polarized wave S2 to be combined so as to exit or enter through the 3-1 outlet 530.

In summary, the ultra-wideband dual linear polarized wave waveguide antenna 1 for communication according to the present disclosure is formed by stacking the first layer 10 to the third layer 30 so that a plurality of the unit antennas 100 is arranged.

In the receiving mode, the number of the unit antennas 100 is a multiple of two, so that first polarized waves S1 or second polarized waves S2 of adjacent unit antennas 100 are combined and then the combined first polarized wave is again combined with a signal combined in two adjacent unit antennas 100, and so on, and finally a resulting wave exits through the 1-1 outlet 510, the second outlet 520 or the 3-1 outlet 530.

Further, the ultra-wideband dual linear polarized wave waveguide antenna 1 for communication according to the present disclosure may include an extended path 700 a part of which is bent at a first exit path 610 or a second exit path 620 so that the first outlet 400 and the first polarized wave guide 200 in the second layer 20 are connected to the linear first exit path 610, the 1-1 outlet 510 and the second outlet 520 and the second polarized wave guide 300 in the third layer 30 are connected to the linear second exit path 620, and a first polarized wave S1 passing through the first exit path or the second polarized wave S2 passing through the second exit path 620 may circle at a certain area so as to extend the length of passing.

As shown in FIG. 10, the extended path 700 is configured such that the length of the path including the second polarized wave guide 300 and the second exit path 620 on the upper side and those on the lower side are equal to each other with respect to the center portion where the 1-1 outlet 510, the second outlet 520 or the third outlet 430 is formed, so that the first polarized wave S1 and the second polarized wave S2 are in-phase for compensation.

The same applies to when the extended path 700 is formed in the second layer 20 other than the third layer 30, and a plurality of the extended paths 700 may be formed.

Figure 12:
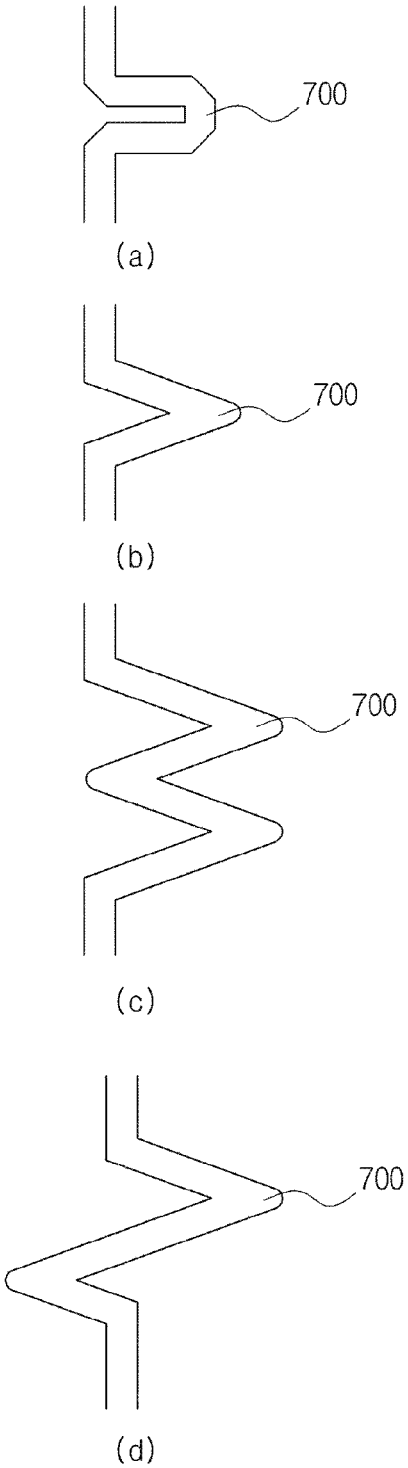
FIG. 12 is a series of views of various types of extended path formed in an ultra-wideband dual linear polarized wave waveguide antenna for communication according to an embodiment of the present invention.
Figure 13:
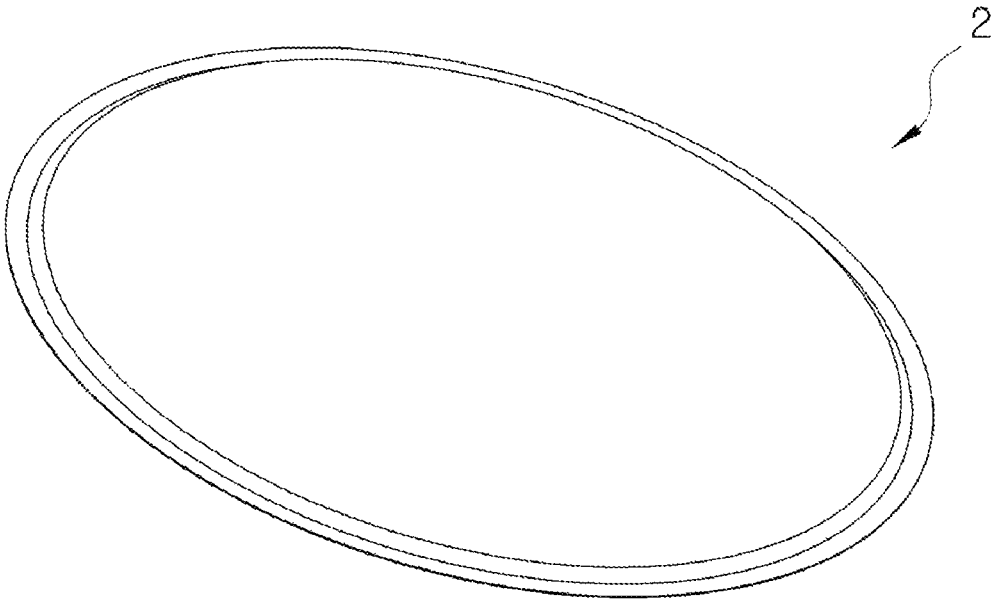
FIG. 13 is a perspective view of a cover member formed on an ultra-wideband dual linear polarized wave waveguide antenna for communication according to an embodiment of the present invention.
Figure 14:
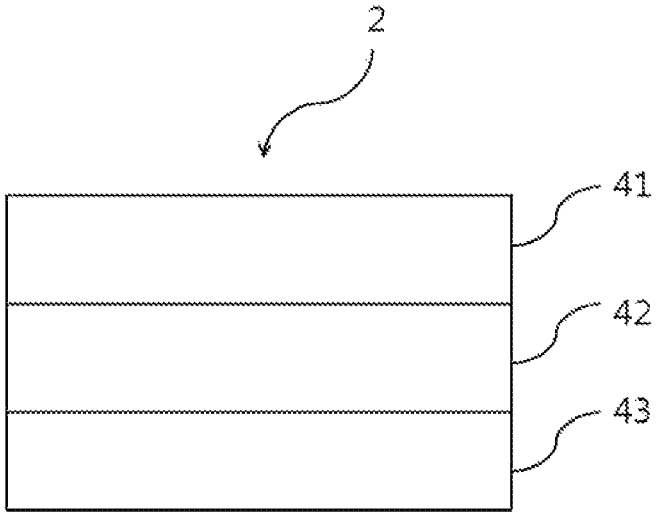
FIG. 14 is a view illustrating a structure of a cover member formed on an ultra-wideband dual linear polarized wave waveguide antenna for communication according to an embodiment of the present invention.

The extended path 700 may have any one of U-, V-W-, and N-shapes as shown in FIG. 12, and may have other shapes as long as the extended path 700 is longer than the straight-line distance from the start point to the end point of the extended path 700.

Further, the ultra-wideband dual linear polarized wave waveguide antenna 1 for communication according to the present disclosure may further include a cover member 2 that covers the outside and has a multi-layer structure of two or more layers made of different materials.

In general, an antenna includes a cover for protecting inner components and an antenna part, and the propagation loss factor caused by the cover is very important factor to the performance of the antenna. As a cover of an antenna is thinner, the propagation loss factor is lower, but the durability may be lowered. Accordingly, required is a cover having an appropriate structure for minimizing the propagation loss factor.

In light of the above, the ultra-wideband dual linear polarized wave waveguide antenna 1 for communication according to the present disclosure includes a cover member having a multi-layer structure for minimizing the propagation loss factor.

The cover member 2 may have a three-layered structure in which a first sheet 41 located at the first layer, a third sheet 43 located at the third layer, and a second sheet 42 located at the second layer therebetween.

The second sheet 42 may be formed of a honeycomb sheet made of aramid material which is a low-dielectric material and has most similar performance to the air layer or Styrofoam.

The first sheet and third sheet may be made of ABS or Prepreg sheets in view of durability.

Accordingly, the ultra-wideband dual linear polarized wave waveguide antenna for communication according to the present disclosure has a wideband matching structure in which the inner peripheral surface of the first polarized wave filtering unit or the second polarized wave filtering unit are tapered such that a diameter of the inner peripheral surface becomes smaller, which filter the first polarized wave or the second polarized wave coming through the signal input/output unit and orthogonal to each other, and thus the bandwidth is enlarged up to 10.7 GHz to 14.5 GHz, so as to include both of the reception band and transmission band, so that it is capable of both receiving and transmitting.

Further, the ultra-wideband dual linear polarized wave waveguide antenna for communication according to the present disclosure is provided with an extended path that extends the waveguide path so that the first polarized wave and the second polarize wave are in-phase, and thus skew angles can be adjusted without mechanically rotating the antenna.

In addition, the ultra-wideband dual linear polarized wave waveguide antenna for communication according to the present disclosure is capable of both receiving and transmitting and of adjusting skew angles, so that dual linear polarized wave antenna which has previously been used for receiving satellite broadcasting can extend its applications, and can make better use of a space since it does not require mechanical rotation for adjusting skew angles.

The present invention is not limited to the above-mentioned exemplary embodiments but may be variously applied, and may be variously modified by those skilled in the art to which the present invention pertains without departing from the gist of the present invention claimed in the claims.

The invention claimed is:

1. An ultra-wideband dual linear polarized wave waveguide antenna for communication, comprising:

a signal input/output unit that receives or transmits a first polarized wave and a second polarized wave orthogonal to each other;

a first polarized wave filtering unit that filters the first polarized wave provided from the signal input/output unit and has stair-like steps formed on its inner peripheral surface, wherein the inner peripheral surface of the first polarized wave filtering unit is tapered as it extends away from the signal input/output unit for wideband matching such that a diameter of the inner peripheral surface of the first polarized wave filtering unit becomes smaller; and a second polarized wave filtering unit that filters the second polarized wave provided from the signal input/output unit and making an angle at 90 degrees with the first polarized wave and has a square pillar shape, wherein an inner peripheral surface of the second polarized wave filtering unit is tapered as it extends away from the signal input/output unit for wideband matching such that a diameter of the inner peripheral surface of the second polarized wave filtering unit becomes smaller;

a first polarized wave guide that is connected to an opening in a side where the steps of the first polarized wave filtering unit are formed so as to guide the first polarized wave;

a second polarized wave guide that is connected to the second polarized wave filtering unit on an opposite side to the signal input/output unit so as to guide the second polarized wave;

a first layer in which a plurality of the signal input/output units are arranged;

a second layer connected to the signal input/output unit and having the first polarized wave guide formed therein;

a third layer connected to the signal input/output unit, arranged in parallel to the first polarized wave guide and having the second polarized wave guide formed therein;

a linear first exit path to which the first polarized wave guide is connected;

a linear second exit path to which the second polarized wave guide is connected; and an extended path formed by bending a part of the first exit path or the second exit path such that the first polarized wave passing through the first exit path or the second polarized wave passing through the second exit path circles at a predetermined area so as to extend a length of passing, wherein an overall length of the extended path formed by bending the linear first exit path or linear second exit path is longer than a straight-line distance from a start point to an end point of the extended path, and wherein the extended path extends the waveguide path such that the first polarized wave and the second polarized wave are in-phase, the first exit path is connected to a third outlet, the extended path and the second exit path are connected to a 3-1 outlet, which is a circular wave guide, and the first polarized wave passing through the first exit path and the second polarized wave passing through the second exit path are combined and then received and transmitted at the 3-1 outlet, thereby adjusting skew angles.

2. The ultra-wideband dual linear polarized wave waveguide antenna of claim 1, wherein the extended path has one of U-, V-, W-, and N-shapes.

3. The ultra-wideband dual linear polarized wave waveguide antenna of claim 1, further comprising: a cover member that covers outside of the antenna and has a multi-layer structure of two or more layers made of different materials.

4. The ultra-wideband dual linear polarized wave waveguide antenna of claim 3, wherein the cover member has a three-layered structure in which a first sheet and a third sheet are made of ABS or prepreg sheets and located at the first layer and at the third layer, respectively; and a second sheet is made of a honeycomb sheet formed of aramid material or Styrofoam and located at the second layer therebetween.

* * * * *